US005823031A

United States Patent [19]

Campbell et al.

[11] Patent Number: 5,823,031

[45] Date of Patent: Oct. 20, 1998

[54] METHOD AND APPARATUS FOR BULGE FORMING AND BENDING TUBES

[75] Inventors: Larry D. Campbell, Littleton; Gary Demartelaere, Conifer; Ronald R. Stange, Littleton, all of Colo.

[73] Assignee: Tools for Bending, Inc., Denver, Colo.

[21] Appl. No.: 754,109

[22] Filed: Nov. 20, 1996

[51] Int. Cl.[6] ..... B21D 9/05; B21D 39/20

[52] U.S. Cl. ..... 72/58; 72/150; 72/152; 72/370; 29/421.1

[58] Field of Search ..... 72/150, 152, 370, 72/58, 62; 29/421.1

[56] References Cited

U.S. PATENT DOCUMENTS

| | | | |
|---|---|---|---|
| 2,971,556 | 2/1961 | Armstrong et al. | 72/370 |
| 3,564,886 | 2/1971 | Nakamura | 72/62 |
| 3,595,047 | 7/1971 | Fanning | 72/58 |
| 4,109,365 | 8/1978 | Tygart | 29/421 R |
| 4,513,497 | 4/1985 | Finch | 29/727 |
| 4,519,230 | 5/1985 | Chachin et al. | 72/56 |
| 4,649,493 | 3/1987 | Castner et al. | 364/472 |
| 4,730,474 | 3/1988 | Iwakura et al. | 72/61 |
| 4,774,826 | 10/1988 | Hann | 72/54 |
| 4,827,605 | 5/1989 | Krips et al. | 29/727 |
| 5,097,689 | 3/1992 | Pietrobon | 72/58 |
| 5,392,626 | 2/1995 | Blezard et al. | 72/62 |

FOREIGN PATENT DOCUMENTS

| | | | |
|---|---|---|---|
| 2591514 | 6/1987 | France | 72/62 |
| 727270 | 4/1980 | U.S.S.R. | 72/370 |
| 1250343 | 8/1986 | U.S.S.R. | 72/58 |
| 1322556 | 12/1988 | U.S.S.R. | 72/62 |
| 1692708 | 11/1991 | U.S.S.R. | 72/150 |

*Primary Examiner*—David Jones
*Attorney, Agent, or Firm*—John E. Reilly

[57] ABSTRACT

There is provided a device and manner for bulge forming and bending a tube or hollow extrusion, such as a pipe or conduit. The one portion of the length of the tube is bulge-formed to define a radially expanded, contoured section of the tube, while another portion of the tube length is bent to define an angle or curve in the tube. The device employs a radially expandable mandrel which serves both as the expandable member for bulge-forming the tube, as well as a bending mandrel to stabilize the tube against wrinkling or collapse during bending.

32 Claims, 3 Drawing Sheets

METHOD AND APPARATUS FOR BULGE FORMING AND BENDING TUBES

BACKGROUND AND FIELD OF THE INVENTION

The invention relates to a method and apparatus for shaping tubes, and more particularly to a method and apparatus for bulge forming and bending a tube such as a pipe or hollow extrusion.

It is often desirable to provide a tube having a relatively enlarged radius along a discrete portion of the tube length. In many instances, by radially expanding the tube against a surrounding mold die the radially expanded portion is provided with a contoured exterior shape. Commonly, a resiliently expandable member is placed in the portion of the tube to be expanded, and the member is compressed axially to cause it to expand radially to deform or "bulge form" the tube against an exterior die set.

U.S. Pat. No. 4,109,365 to Tygart briefly describes some of the conventional devices and methods for radially expanding and contouring a portion of a tube. The Tygart device, like many devices known in the art, employs a resilient member, such as a section of polyurethane, to deform the desired portion of the tube. Tygart teaches the placement of the member within the tube, and the use of two independently operable rams on either side of the member. The rams are movable axially inward to squeeze the member between them to cause the member to expand radially.

Other known devices and modes for expanding a portion of tube are typified by U.S. Pat. No. 4,513,497 to Finch, which uses a hydraulically inflatable bladder to deform a surrounding tube element. The object of the Finch device is to expand a "patch" sleeve to secure it within a deteriorating outer pipe; the outer pipe is not deformed, and no dies are used to attain a particular contoured exterior shape.

It frequently also is desirable to bend a tube axially to form an angle in the tube, for example to provide a conduit which transports fluid around a corner. Common modes of rotary tube bending involve clamping the forward section of the tube to the bend die, and positioning an axially movable pressure die on a rotatable bending die. The clamping portion of the bend die and clamp die, while gripping the tube, are rotated, forcing the tube around and into bend die groves. The angular rotation of the bend die bends the tube to a corresponding desired degree of bend. The pressure die moves axially to remain in position to counteract the bending moment created when the tube is pushed against the rotating bending die.

It is known in the art of tube bending to place a bending mandrel inside the tube to guard against wrinkling or collapse of the tube during bending. Mandrels provide interior support to prevent the tube wall from deforming radially inward while the tube bends. A variety of mandrel types are known in the art, including multiple ball mandrels and steel-link mandrels.

Frequently, there is a need for a tube which is radially expanded along one section of its length, and axially bent at another section. Forming such a tube heretofore involved the use of distinct methods and manufacturing devices. Most current methods for making such specially shaped tubes typically use hydroforming or a bulge-forming device similar to the Tygart device to bulge and contour the one section of the tube, and then shift the tube to a second bending machine to bend the second portion of the tube. Because two separate devices and discrete methods are utilized, the process is time consuming and complicated.

A need remains, therefore, for a single apparatus and method for sequentially expanding and bending a tube. Ideally, such an apparatus should first radially expand one portion of the tube to shape it into a desired contour, and then nearly immediately thereafter bend a second portion of the tube axially. The expansion process and the bending process, while occurring consecutively, ideally are performed in rapid succession. Against the foregoing background, the present invention was developed.

The Tygart device of U.S. Pat. No. 4,109,365 requires that power sources and active compression rams be located axially on both sides of the member, effectively precluding the use of the member as a bending mandrel. Among other advantages of the present invention is the use of a single mandrel element to perform both expansion and bending functions in a novel and improved manner. To our knowledge, no known devices or methods for shaping tubes employ a single mandrel in the dual role of both an expansion member for expanding the tube circumferentially, and a bending mandrel for internally supporting the tube during bending.

SUMMARY OF THE INVENTION

An object of the invention is to provide a novel and improved method and apparatus for circumferentially expanding a tube.

Another object of the invention is to provide a method and apparatus for successively expanding and bending a tube.

Another object of the invention is to provide a dual-function mandrel which expands circumferentially to bulge a tube, and which also supports the tube during bending, and wherein the bulge-forming and bending of a tube may be performed with a single apparatus.

In accordance with the present invention, there is provided a method for bulge-forming a portion of a tube comprising the steps of disposing a flexible, radially expandable mandrel within the portion of the tube, the mandrel having a free end and a stationary base end, and pulling the free end of the mandrel axially toward the base end thereby axially compressing the mandrel to cause circumferential expansion of the mandrel under sufficient force to expand the portion of the tube surrounding the mandrel into a desired contour or non-round shape. Also in accordance with the invention, there is provided a method for forming a tube, the tube having a portion to be expanded and a portion to be bent, wherein the method comprises placing a mandrel within the portion of the tube to be expanded, radially expanding the mandrel to apply a deforming force to the portion to be expanded, radially contracting the mandrel, disposing the flexible mandrel at least partially within the portion of the tube to be bent, and bending the portion to be bent while the mandrel is at least partially compressed within the portion to be bent.

In accordance with the present invention, there also is provided an apparatus for bulge-forming a portion of a tube wherein the apparatus comprises a flexible, radially expandable mandrel disposable within the portion of tube, the mandrel having opposite compression end members; and means, disposed at least in part between the end members, for axially compressing the end members to cause radial expansion of said mandrel. In an apparatus for forming a tube, the tube having a portion to be expanded and a portion to be bent, an elastically flexible and expandable mandrel is disposable within the portion of the tube to be expanded, means for circumferentially expanding the mandrel to apply a deforming force to the portion to be expanded, means for disposing the mandrel at least partially within the portion of the tube to be bent, and means for bending the portion to be bent while the mandrel is at least partially within the portion to be bent.

The above and other objects of the present invention will become more readily appreciated and understood from a consideration of the following detailed description of preferred and modified forms of the present invention when taken together with the accompanying drawings in which:

DETAILED DESCRIPTION OF A PREFERRED EMBODIMENT

The invention comprises apparatuses and methods for shaping and bending a tube, including but not limited to a pipe, hollow extrusion, or the like. A radial cross section of a tube most commonly defines a circular annulus, and oval sections are occasionally encountered, but a tube may have nearly any cross section. For purposes of the invention, the tube generally is made of workable metals or metal alloys, for example aluminum, but the invention may successfully be practiced with tube fashioned from other ductile materials including stainless steel, brass, and copper. The invention is directed toward the plastic deformation of materials that may become substantially rigid during intended use.

Figures 1, 2:
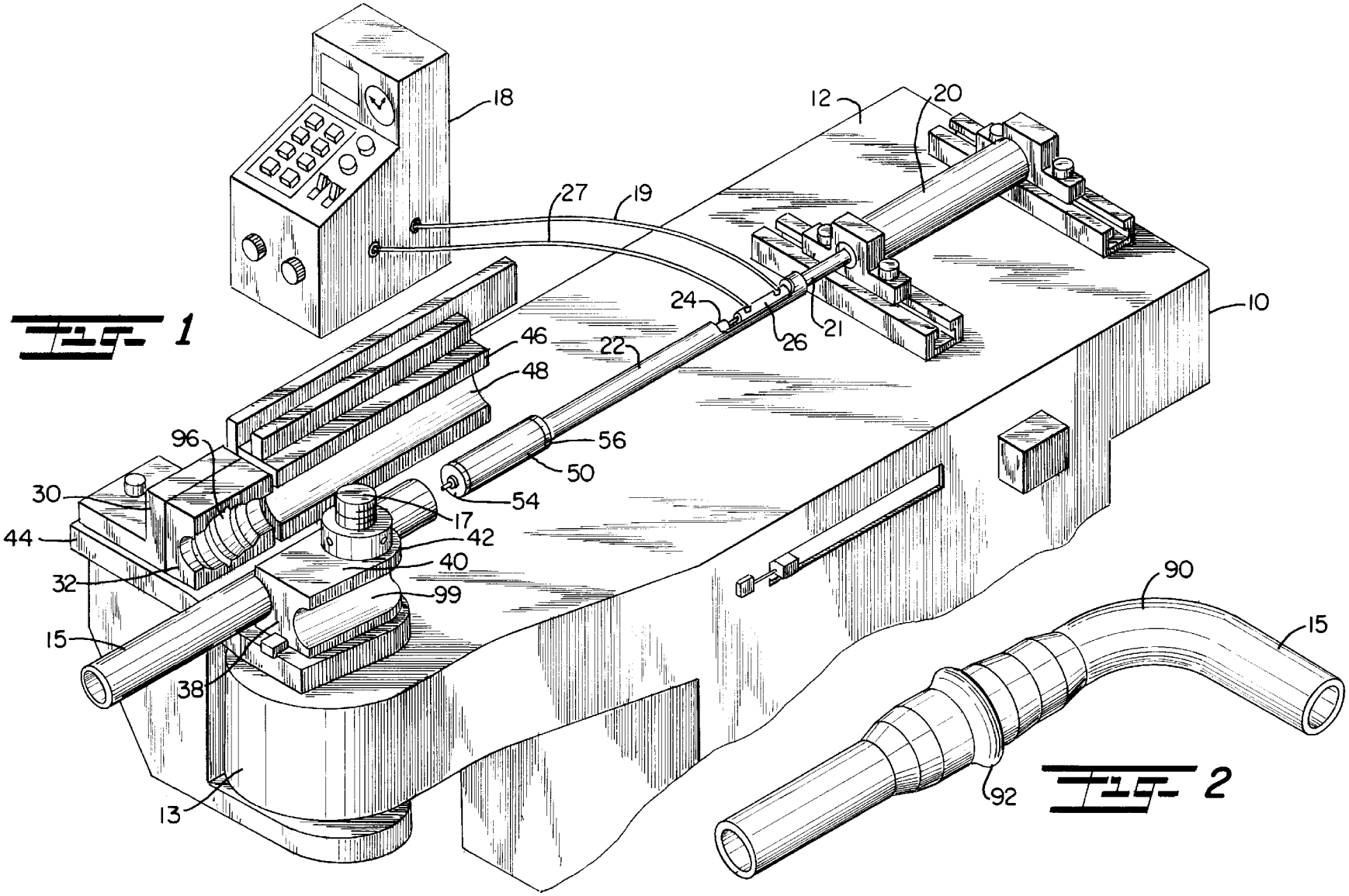
FIG. 1 is a perspective view of a preferred embodiment of the apparatus of the invention.
FIG. 2 Is a perspective view of a length of tube, showing a portion of the tube radially expanded according to the method and apparatus of the invention, and another portion of the tube bent at an angle according to the method and apparatus of the invention.

The invention may be understood with reference to the drawings, in which like reference numerals and symbols refer to the same item. In the art of tube forming, it occasionally is desirable to shape a single piece of tube to have a portion that is expanded to manifest an enlarged radial cross section and contoured longitudinal section, and another portion that is bent to some predetermined angle. For example, FIG. 2 illustrates a length of tube 15 having a bent portion 90 bent at about a 90-degree angle, and an axially adjacent expanded portion 92 that bulges to define a desired contour. The present invention provides a method and apparatus to quickly and reliably expand and bend a length of tube to a configuration similar to FIG. 2 (although practically any expanded contour and angle of bend are possible by the invention). An advantage of the invention is that expansion and bending may be sequentially performed with a single apparatus. Alternatively, the method and apparatus of the invention may be utilized either to bend or to expand a portion of tube. Particularly, the present invention can radially or circumferentially expand tube without bending it axially, if desired.

Figure 3:
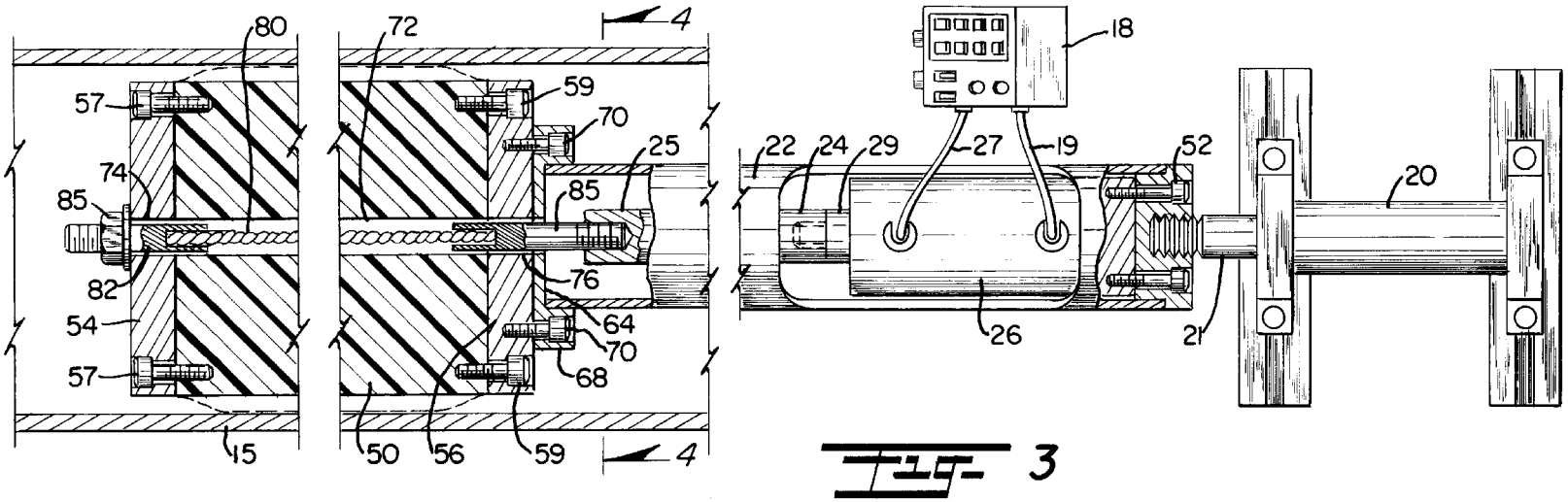
FIG. 3 is an enlarged, partially sectional, top plan view of the apparatus shown in FIG. 1, showing the mandrel element in a substantially relaxed state within an unexpanded portion of tube.

There is shown in FIG. 1 an overall view of the apparatus of the invention. The principal components and elements of the apparatus are collected at a work station and mounted upon or about a large oblong bench 10 familiar to the art, which holds the elements at a comfortable working height and maintains them in proper spacial interrelation. Referring also to FIG. 3, the tube 15, comprising a section of tube or other workpiece to be shaped, is slipped axially over the mandrel rod 22 and flexible mandrel 50, and thereon supported above the bed 12 of the bench 10 in preparation for forming and bending. The mandrel rod 22 and flexible mandrel 50 are movable axially by controlled operation of a main hydraulic mandrel extract 20. The flexible mandrel 50 is bendable and controllably expandable, as explained further herein.

During the practice of the invention, the tube 15 is clamped between a clamp die 32 and a clamping portion 40 of a bending die 38. The mandrel 50 is expanded to radially bulge the tube 15 against contoured mold surfaces of the clamping die 32 and the clamping portion 40 of the bending die 38. Then, after controlled relaxation of the flexible mandrel 50, the clamp die 32 and bending die 38 are rotated by and upon a pivoting yoke or swing arm 31 to bend the tube 15 against the bending die 38, while a pressure die 46 prevents the tube 15 from rotating with the swing arm 31. During bending, the tube 15 slides axially and bends within the portion around the portion supported by the flexible mandrel, thus providing interior support against undesirable wrinkling or collapse of the tube. The process of the invention preferably is largely automated, controlled by an operator and/or programmable computer at a nearby main control panel and hydraulic power source 18.

The tube or workpiece 15 is movable axially in relation to the expandable mandrel 50. On benders not equipped with Computer Numerical Control devices, the tube 15 is pushed by the operator to the desired location of the first bend.

Movably disposed upon the front end of the bench 10, opposite the mandrel extract cylinder 20, are the clamp die 32 and bending die 38. The pressure die 46 is movably mounted alongside the bench 10 above the bed 12. As herein described, as the tube 15 undergoes axial movement away from the hydraulic extract cylinder 20, the clamp die 32, bending die 38 and pressure die 46 act in concert upon the tube 15 to accomplish the bulging and bending processing of the tube.

At the outset of the practice of the invention, the tube 15 is placed upon and about the hollow mandrel rod 22 supported between the main hydraulic extract cylinder 20 and the clamp die 32. As seen in FIG. 3, the back end of the mandrel rod 22 is provided with a secured fitting 52 wherewith the mandrel rod 22 has threaded or similar connection to the driving piston 21 extending from the extract cylinder 20. Axial movement of the piston 21 thus is transmitted directly to the mandrel rod 22. Connected to the leading other end of the mandrel rod 22, generally proximate to the clamp die 32 and bending die 38, is the expandable mandrel 50 to be further described.

In the practice of the invention, the expandable mandrel 50 and the mandrel rod 22 are axially inserted into the interior of the tube 15. The operator adjustably moves the tube 15 until the portion to be bent is positioned adjacent the dies 32, 38.

As best shown in FIG. 1, a sturdy head 13 extends from the front end of the bench 10. A C-shaped swing arm 31 is pivotally mounted upon the head 13 by means of a vertical spindle 17. Swing arm 31 may rotate about the vertical axis defined by the spindle 17, and thus swing in a substantially horizontal arc, preferably at least 180 degrees, around the head 13. The sliding contact of the upper and lower arms of the swing arm 31 with the head 13 prevents the swing arm from substantial vertical movement. Contained in the head 13 and bed 10 is a dual sprocket and chain assembly (not shown) activated by a hydraulic pump to provide rotary power to the swing arm 31.

Figure 7:
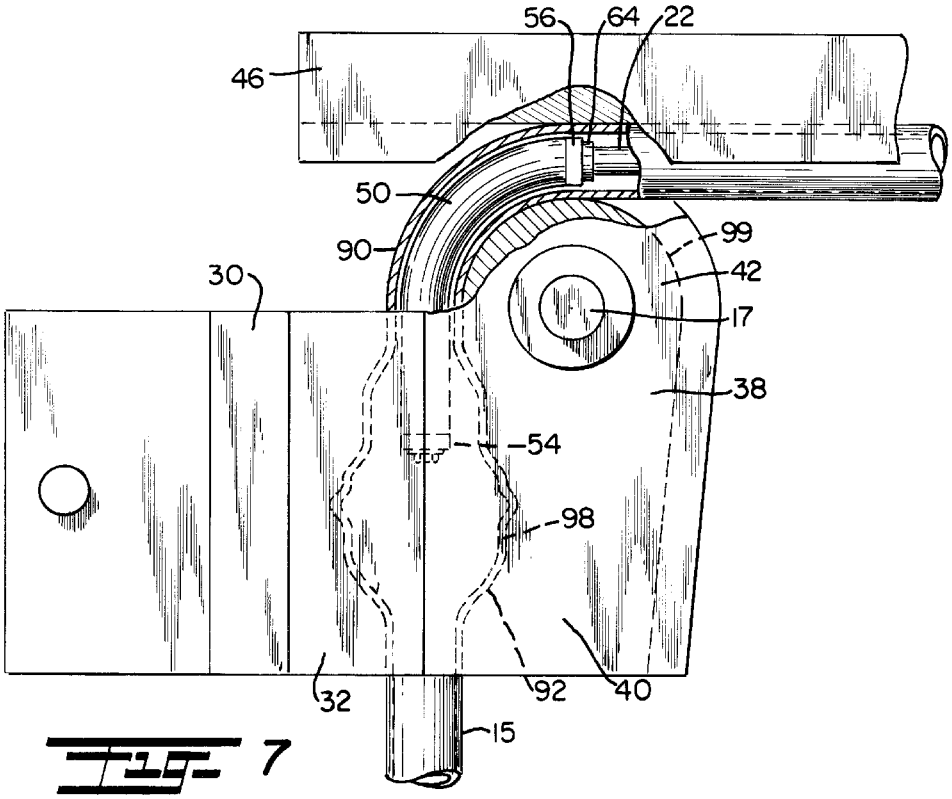
FIG. 7 is another partially sectional top plan view of the portion of the apparatus shown in FIG. 6, depicting the mandrel element and a portion of the tube in a bent configuration according to the method and apparatus of the invention.

The swing arm 31 is a swivel for the bending die 38 and the clamp die 32. The bending die 38 is attached to the top of the swing arm 31. The position of the bending die 38 with respect to the arm 31 preferably is adjustable, but during the operation of the apparatus the bending die 38 is fixed upon and moves with the swing arm 31. As shown in FIGS. 1 and 7, the bending die 38 is disposed about the upper portion of the vertical spindle 17, so that the rotation of bending die 38 is generally coaxial with the rotation of the arm 31.

Also upon the top of the swing arm 31 and directed radially outward from the vertical spindle 17 is a track 44 upon which the clamp die 32 may move linearly. As the arm 31 swivels, the track 44 likewise correspondingly revolves about the spindle 17 similar to the spoke of a wheel, as suggested in FIGS. 6 and 7. The clamp die 32 is power driven by known methods back and forth along the track 44, i.e., radially toward and away from the bending die 38. Accordingly, clamp die 32 is movable along the track 44 radially away from bending die 38 to permit placement of the tube 15 between the clamp die 32 and the bending die 38, and then is movable back toward the bending die 38 firmly to clamp the tube 15 between the clamp die 32 and the clamping portion 40 of the bending die 38.

As shown by combined reference to FIGS. 1 and 5–7, the clamp die holder 30 preferably supports a removable female clamp die 32 defining a generally longitudinal concave mold surface 96. The mold surface 96 is configured to be complementary to the desired external configuration of the tube to be contoured, such as the contoured expanded portion 92 of tube shown in FIG. 2. Clamp die 32 is secured to and moves with the clamp die holder 30 during operation, but is removable to provide interchangeability with clamp dies defining other shapes.

Figure 5:
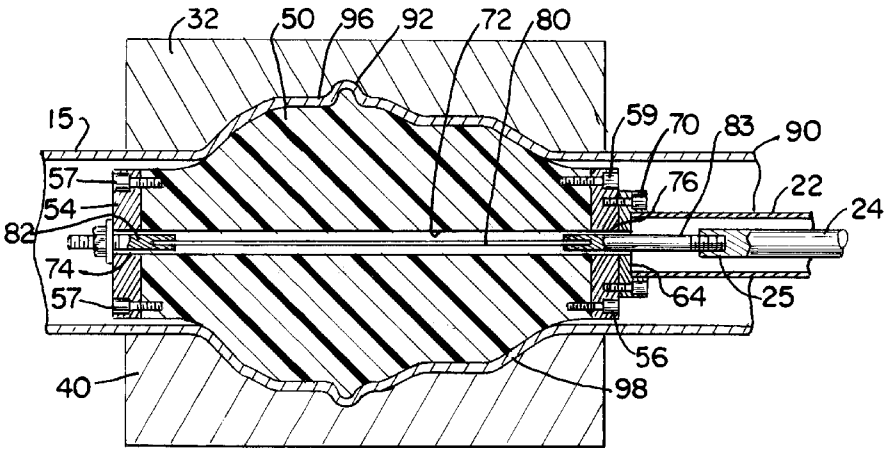
FIG. 5 is an axial sectional view of a portion of the apparatus of the invention, showing the mandrel element radially enlarged and a portion of tube expanded against surrounding dies.
Figure 6:
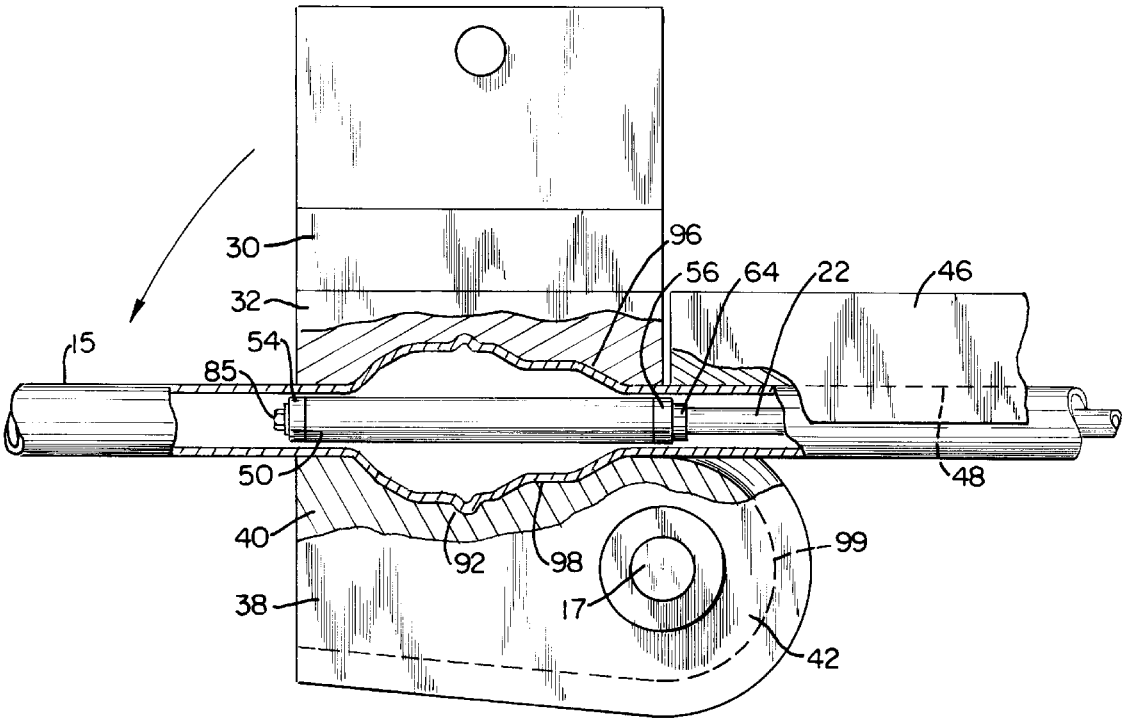
FIG. 6 is an enlarged partially sectional top plan view of a portion of the apparatus, showing the mandrel element in a substantially relaxed state within a portion of tube that has been expanded against surrounding dies.

Bending die 38 has two die features, a tangential clamping portion 40 and a circular rolling or bend portion 42. The clamping portion 40 is firmly engaged against the exterior of the tube 15 during practice of the invention, so that when clamp die 32 is drawn securely against the tube, the tube is securely and immovably clamped or gripped between the clamp die 32 and the clamping portion 40. As best shown by FIGS. 5 and 6, the clamping portion 40 defines a second longitudinal concave mold surface 98. The two die mold surfaces 96, 98 are employed during the expansion process of the invention. The mold surface 98 on the bending die 38 usually, but not necessarily, is a corresponding reflection of the mold surface 96 on the clamp die 32. The two mold surfaces 96, 98 thus ordinarily are substantially the same, so that when the dies 32, 38 are brought together they may define an axially symmetrical mold space therebetween which corresponds to the desired ultimate shape of the portion 92 of the tube to be expanded (FIG. 2).

The bending portion 42 of the bending die 38 is used to accomplish the bending steps of the inventive process. The portion 42 includes a concave groove 99 which receives the bent portion of the tube, as indicated in FIGS. 1, 6, and 7. When the bending die 38 rotates about the spindle 17 during operation of the invention, the tube 15 presses against a progressively lengthening segment of the bending surface 99, so that the tube 15 effectively is forced to follow and assume the generally circular contour of the portion 42.

Pressure die 46 is movably disposed generally parallel to and at substantially the same height as the tube 15 when the tube 15 is disposed upon the expandable mandrel 50 and mandrel rod 22. Pressure die 46 is longitudinally parallel to the mandrel 50, and presses against the tube 15 during operation of the invention to counteract the moment force generated during the bending of the tube by the engagement of the tube 15 with the rotating bending die 38.

Combined reference is made to FIGS. 1, 3, and 6. As mentioned, the mandrel rod 22 connects the expandable mandrel 50 to the extract cylinder 20. When the expandable mandrel 50 and mandrel rod 22 are inserted within the tube 15, the operator adjusts the axial position of tube 15 with respect to the dies 32, 38.

Fixed within the back end of the mandrel rod 22 is an auxiliary hydraulic cylinder 26 connected to the end of a longitudinal drive bar 24. As best seen in FIG. 3, the auxiliary cylinder 26 is rigidly fixed, as by screws, to the fitting 52 so as to be immovable with respect to the mandrel rod 22. Movement of the drive piston of the main extract cylinder 20 automatically results in a corresponding axial movement of both the mandrel rod 22 and the auxiliary cylinder 26, and the latter two components thus always move together.

Drive bar 24 is disposed coaxially within the hollow interior of mandrel rod 22, and preferably comprises a rigid solid shaft. Auxiliary hydraulic cylinder 26 moves drive bar 24 reciprocally axially within the mandrel rod 22. Auxiliary cylinder 26 is in communication with main control panel and hydraulic pump 18 by way of hydraulic tubing 27 and 19, so that the operator using main control panel 18 can selectively regulate the translation of the drive bar 24 axially within the mandrel rod 22. Axial movement of the drive bar 24 occurs coaxially with, but independently of, the movement of the mandrel rod 22. A section of the mandrel rod 22 radially adjacent to the auxiliary cylinder 26 preferably is cut away as shown in FIGS. 1 and 3 to provide a window through which the auxiliary cylinder 26 and the connected end of the drive bar 24 may be accessed for adjustment and maintenance.

Figure 4:
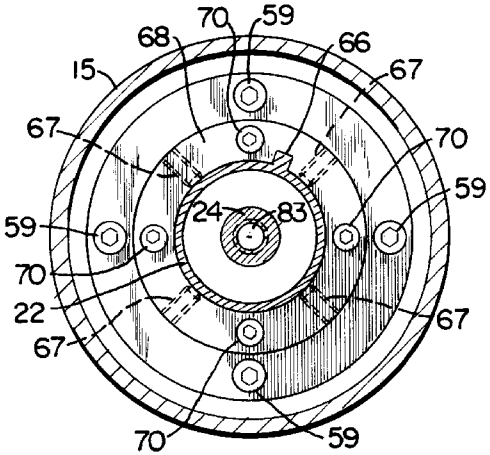
FIG. 4 is a radial sectional view of a portion of the apparatus of the invention, taken substantially along line 4—4 in FIG. 3.

FIGS. 3–5 illustrate the preferred construction of the assembly associated with flexible mandrel 50, and the attachment of the flexible mandrel 50 to the mandrel rod 22. For ease of description, the left sides of FIGS. 3 and 5 are referred to as directionally corresponding to the "front," "leading," or "forward" part of the apparatus, while the right sides of those figures are referred to as corresponding directionally to the "back." In FIG. 3, the flexible mandrel 50 is depicted in a relaxed condition concentrically within the tube 15; in FIG. 5, the flexible mandrel 50 is shown in an expanded state, forcing a portion of the tube 15 outwardly against the respective mold surfaces 96, 98 of the clamp die 32 and the bending die 38.

The flexible mandrel 50 itself comprises a nearly solid piece of elastically compressible material, preferably urethane of a selected durometer. Other resilient polymers may be used to fashion the mandrel 50, provided the mandrel is elastically compressible and bendable and has a low-friction or lubricous surface. Flexible mandrel 50 corresponds generally in cross-sectional shape to the interior hollow within the tube 15. Preferably, the flexible mandrel 50 is a solid oblong cylinder having a diameter, when in the fully relaxed condition, of just less than the inside diameter of the tube 15. The flexible mandrel 50 is at least as long as the clamp die 32, but as shown in FIG. 6 preferably has a length substantially corresponding to the length of the clamp die 32. The mandrel 50 is substantially solid except for a narrow cylindrical cable or chain channel 72 running centrally and axially therethrough.

The flexible mandrel 50 is longitudinally sandwiched between a pair of compression plates 54, 56. Both compression plates 54, 56 are substantially solid, rigid, disk-shaped elements resistant to bending. Front compression plate 54 and back compression plate 56 are completely penetrated at their respective centers by small circular cable ports 74 and 76 respectively.

Front compression plate 54 is securely attached, as by screws or the like, to the front or free end of the flexible mandrel 50. Front screws 57 penetrate front compression plate 54 and enter the flexible mandrel 50 so as to prevent front compression plate 54 from moving either axially or radially with respect to the flexible mandrel. Back compression plate 56 likewise is secured to the back end or base of the flexible mandrel, as by screws 59, or the like, to prevent radial or axial rotation of back compression plate 56 with respect to the flexible mandrel 50. Compression plates 54, 56 thus are parallel and spaced apart axially by the length of the flexible mandrel 50.

As shown in FIGS. 3–5, the leading end of the mandrel rod 22 proximate to the flexible mandrel 50 is fitted with a rigid flanged collar 64. The collar 64 is counterbored with an inside diameter corresponding generally to the outside diameter of the mandrel rod 22, to coaxially accept therein the leading end of the mandrel rod 22. A longitudinal key 66 upon the outside of the mandrel rod 22 engages a corresponding keyway in the collar 64 to assure a positive radial fix between the mandrel rod 22 and the collar 64. A number of set screws 67 radially penetrate the collar 64 and are turned against the outside of the mandrel rod 22 to releasably anchor the collar 64 in axial position upon the rod 22.

The flange 68 on the collar 64 is removably attached to the back compression plate 56 on the base of the mandrel 50. The flange 68 preferably is pierced by an array of holes that align with a corresponding pattern of bolt holes in the back compression plate 56, so that bolts 70 or the like may be screwed through the flange 68 into the back compression plate 56. Several different patterns of bolt holes optionally may be provided through the collar flange 68 to promote interchangeability of a variety of mandrels, each mandrel having a back compression plate 56 with a potentially differing bolt hole pattern.

Continuing reference is made to FIGS. 3–5. A bendable mandrel tendon 80 runs longitudinally between the front compression plate 54 and the leading end 25 of the drive bar 24. The mandrel tendon 80 preferably is a relatively small diameter steel cable, but a suitable alternative bendable filament, chain, rope or the like may adequately be employed. Mandrel tendon 80 is flexibly bendable about its axis, but does not yield significantly when loaded in tension. Mandrel tendon 80 is disposed in the tendon channel 72 through the mandrel 50 and also through the tendon port 76 in the back compression plate 56. As indicated in the figures, the mandrel tendon 80 preferably has a length which corresponds to, or is only somewhat less than, the axial length of the flexible mandrel 50.

Securely annexed to the respective ends of the mandrel tendon 80 are threaded tendon fittings 82, 83. Front tendon fitting 82 is disposed through the tendon port 74 in the front compression plate 54 so that the leading end of the front tendon fitting 82 protrudes on the front side of the front compression plate 54. Preferably, the front tendon fitting 82 is in threaded engagement into the tendon port 74 in the front compression plate 54. A nut 85 with washer is screwed upon the protruding threaded portion of the front tendon fitting 82 to prevent the front tendon fitting 82 from being withdrawn back through the front compression plate 54. The mandrel tendon 80 accordingly is prevented from shifting axially with respect to the front compression plate 52.

Similarly, the back tendon fitting 83 is threadably engaged into the leading end 25 of the drive bar 24. The back end of the mandrel tendon 80 thus is barred against axial movement independently of the drive bar 24.

Continued reference to FIGS. 3–5 illustrates how axial movement of the drive bar 24 effects an expansion or contraction in the flexible mandrel 50. At the outset of the process of the invention, the flexible mandrel 50 is in a relaxed state as shown in FIG. 3. A length of tube 15 is slipped over and around the flexible mandrel 50. The mandrel rod 22 (with the mandrel 50 thereon), the auxiliary hydraulic cylinder 26, and the drive bar 24 are positioned axially within the interior of tube 15 and the portion of the tube to be bent, with the flexible mandrel 50 therein, is positioned between the dies 32, 38.

When the flexible mandrel 50 is disposed within the portion of the tube 15 to be expandably molded, the axial position of the tube 15, as well as the axial positions of the mandrel rod 22 and the back compression plate 56, is fixed in position.

Referring to FIG. 1, the clamp die 32 then is powered along the track 44 and moved into adjacent contact with the exterior of the portion of the tube to be expanded. The clamp die 32 forcibly is pressed against the tube. The portion of the tube to be expanded is thus securely clamped between the clamp die 32 and the clamping portion 40 of the bending die 38. The tube 15 is held in a vise-like grip between the dies 32, 38, although the mold surfaces 96, 98 themselves do not touch the outside of the unexpanded tube. Mold surfaces 96, 98 instead define an annular space around the exterior of the tube 15, into which a portion of the tube may bulge.

With the clamp die 32 and the clamping portion 40 of the bending die 38 firmly clamped about the portion of the tube to be expanded, the pressure die 46 is brought into position parallel with the tube 15, and extending longitudinally from the clamp die holder 30 toward the back of the bench 10. Pressure die 46 has a hemicylindrically concave holding surface 48 substantially corresponding to the outside surface of the tube 15. The holding surface 48 is firmly engaged with the outside of the tube 15, to secure the tube against movement.

Referring again to FIGS. 3 and 5, the operator then activates the auxiliary hydraulic cylinder 26, which is immobile within the mandrel rod 22, to effectuate the radial expansion of the flexible mandrel 50. As shall be described, the mandrel 50 is radially expanded by pulling its front end toward its back or base end, which base end is fixed to the mandrel rod 22. Auxiliary hydraulic cylinder 26 moves its driving piston 29 to induce corresponding axial movement of the drive bar 24 within and with respect to the stationary mandrel rod 22. The auxiliary cylinder 26 retracts the driving rod 24 backwardly (from left to right in FIGS. 3 and 5) axially away from the back compression plate 56. Retraction of the driving rod 24 tenses the mandrel tendon 80, and the tendon pulls back upon the front compression plate 54. Continued retraction of the driving rod 24 loads the mandrel tendon 80 in tension and draws the front compression plate 54 axially toward the stationary mandrel rod 22.

Because the back compression plate 56 is immovably disposed upon the end of the mandrel rod 22, the axial movement of the front compression plate 54 compresses the flexible mandrel 50 between the compression plates 54, 56. Axial compression of the flexible mandrel 50 causes the mandrel 50 to expand radially outward against the wall of the tube 15. The initial movement of the front compression plate 54 first causes mandrel 50 to press firmly against the tube 15; further axial drawing of the front compression plate 54 results in a rapidly rising deforming force upon the inner surface of the tube 15, until the tube yields and bulges outward with the radially expanding mandrel 50.

The operator accordingly controls the auxiliary hydraulic cylinder 26 to retract the driving rod 24, and thereby axially compress and circumferentially expand the mandrel 50 to forcibly press the tube 15 against the die mold surfaces 96, 98. When fully expanded within the dies 32, 38, the flexible mandrel 50 substantially assumes the shape defined by the die mold surfaces 96, 98 of the dies. The tube 15 therefore is pressed between the mandrel 50 and the dies 32, 38, substantially to conform the tube 15 to the contour defined by the die surfaces 96, 98, as shown in FIG. 5.

Once the tube has thus bulged outwardly under the deforming force of the mandrel 50, to be molded by the dies 32, 38, the flexible mandrel 50 may be at least partially restored to its relaxed, substantially cylindrical shape by reversing the axial movement of the driving rod 24. The operator need merely release the auxiliary hydraulic cylinder 26 to permit the driving rod 24 to move forwardly, toward the back compression plate 56. Flexible mandrel 50, being resiliently elastic, has a memory which causes it to return to its original relaxed shape once the compressive forces from the compression plates 54, 56 are removed. Thus, as the driving bar 24 moves axially forward, the decompressing mandrel 50 pushes the front compression plate 54 axially forward until the mandrel is completely relaxed, eventually assuming the configuration shown in FIG. 6.

During either relaxation or compression of the flexible mandrel, the mandrel tendon 80 slides along the tendon channel 72 and through the tendon port 76 in the back compression plate 56. Even with the mandrel 50 fully relaxed, operable connection of front compression plate 54 to the driving bar 24 is maintained by the now unloaded, nearly flaccid mandrel tendon 80. Operation of the auxiliary cylinder 26 allows controlled movement of the drive bar 24, which accordingly permits the operator to regulate the degree to which the mandrel 50 is expanded or relaxed.

An advantage of the invention is that a single inventive apparatus is used to successfully perform the forgoing bulge molding process as well as to bend the tube 15. The tube is bent by gripping it in a vise-like manner and then coaxially rotating the swing arm 31 to wrap the tube around the bending die 38. During bending, a bending mandrel remains within the tube to mitigate against wrinkling or collapse. In this invention, the vise effectively comprises the clamp die 32 and the clamping portion 40 of the bending die 38. The bending mandrel is the flexible mandrel 50 which is used to accomplish the bulge molding, as described. The clamp die 32, clamping portion 40 of the bending die 38, and the flexible mandrel 50 thus serve dual functions previously unknown in the art.

Combined reference is made to FIGS. 6 and 7. The bending step of the inventive process, if desired, is performed after the tube has been bulged into the dies 32, 38, as previously described. Alternatively, the bending step may be omitted, and the tube merely bulge molded.

After completing the bulge forming, the flexible mandrel 50 is deliberately and controllably relaxed until its outside diameter substantially corresponds to or is very slightly less than the original inside diameter of the tube or workpiece 15. Accordingly, the flexible mandrel 50 will have a longitudinal sectional shape substantially like that shown in FIG. 3, but the relaxed mandrel 50 remains within the portion 92 of the tube that has been expandably bulged, as shown in FIG. 6. The operator may carefully actuate the auxiliary cylinder 26 to relax or expand the flexible mandrel 50 as needed in order to minimize the clearance between the outside of the mandrel and the inside wall of the tube 15. Preferably, there is minimal clearance between the flexible mandrel 50 and the tube 15 during bending so that the mandrel 50 provides optimum interior support and buttressing to the tube; yet sufficient clearance is maintained that the mandrel 50 may slide axially within the tube 15 to remain within the portion of the tube to be bent. The interior supporting presence of the mandrel 50 substantially prevents the wall of the tube from collapsing or deforming radially inward during bending, thus minimizing undesirable deformation or kinking.

Continuing reference to FIGS. 6 and 7, the power source is activated to rotate the swing arm 31 in the direction of the directional arrows of FIGS. 1 and 6 (generally counterclockwise in FIG. 6). Rotation of the swing arm 31 rotates the bending die 38 and the rack 44 around the vertical axis defined by the spindle 17. Rotation of the rack 44 also pivots the clamp die holder 30 and clamp die 32 arcuately about the spindle 17.

Because the portion 92 of the tube 15 that has been expanded remains clamped between the dies 32, 38, the rotational movement of the dies also moves the tube 15. The expanded portion 92 of the tube 15 moves arcuately through space with the dies, but is undeformed by the rotational movement. The portion 90 of the tube 15 to be bent may be a segment of the tube adjacent to and in back of (i.e., toward the extract cylinder 20) the dies 32, 38, and is generally identified at 90 in FIGS. 5–7. The rotational movement of the dies 32, 38 deforms the portion 90 of the tube to be bent. As indicated by FIGS. 6 and 7, rotation of the dies 32, 38 pulls the portion of the tube to be bent 90 axially forward while simultaneously wrapping it around the rotating bending die 38 to bend it.

The combined axial and flexural movement of the tube 15 results in the partial or complete withdrawal of the flexible mandrel 50 relative to the expanded portion 92 of the tube, since the flexible mandrel 50 is fixed against axial movement. The continued rotation of the dies 32, 38 effectively places the portion of the tube to be bent 90 around the flexible mandrel 50, as shown in FIG. 7. Thus, by pulling the tube axially with respect to the mandrel 50, the mandrel is effectively positioned within the portion 90 of the tube to be bent.

Notably, because the compression plates 54, 56 are not rigidly connected together, but rather linked by the flexible mandrel tendon 80, the mandrel 50 is fully bendable about its axis. As suggested by FIGS. 3 and 6, the front end of the mandrel 50 is essentially "free"; all the substantial components utilized to compress the mandrel 50, e.g., the collar 64, the drive bar 24, the mandrel rod 22 and the auxiliary cylinder 26) are located only upon or proximate to one end—the base or back end—of the mandrel 50. Because there is no second corresponding collection of compressing components on the other axial side of the mandrel 50, proximate to its leading or free end, the mandrel 50 may freely bend with respect to the fixed back compression plate 56. A resultant advantage of the invention is that as the portion of tube to be bent 90 is bent around the bending die 38, the flexible mandrel 50 therein likewise bends correspondingly, continuing throughout the process to provide internal support for the tube 15.

As the dies rotate about the spindle 17 to pull forward the portion of the tube to be bent, the entire length of tube 15 above the bed 12 slips axially forward upon the immobile mandrel 50 and mandrel rod 22 to position the mandrel 50 at least partially within the bending portion of the tube, as shown in FIG. 7. Pressure die 46, engaged parallel against the tube, is controllably shifted axially forward at a rate corresponding to the axial movement of the tube; pressure die 46 thus continuously serves as a counterbrace against the moment generated by the rotary bending of the tube around the bending die 38.

The axial speed of the shifting pressure die 46 corresponds generally to the radial speed of the bending die 38 at a point upon the holding surface 48. Thus, as the dies 32, 38 swivel arcuately about the spindle 17, the tube advances between the pressure die 46 and the curved portion 42 of the bending die 38 to be bent into a horizontal arc corresponding to the arc defined by the bending surface 99. The extent of the angular rotation of the bending die 38 determines the radius at which the tube will be bent. The swing arm 31 may pivot through an arc of at least 180 degrees, permitting the tube correspondingly to be bent at 180 degrees to define a curved conduit which reverses the spacial direction of flow therethrough. It is immediately appreciated that controlled rotation of the dies thus can produce an arcuate bend in the tube 15 of between zero and 180 degrees; a typical bend of about 90 degrees is illustrated in FIGS. 2 and 7.

It is therefore to be understood that while a preferred embodiment of the present invention is herein set forth and described, the above and other modifications and changes may be made without departing from the spirit and scope of the invention as defined by the appended claims and reasonable equivalents thereof.

We claim:

1. A method for expanding a portion of a tube, said tube having a longitudinal axis, the method comprising:

disposing a resilient, radially expandable mandrel within the portion of said tube, the mandrel having a free end and a stationary base end;

pulling the free end of said mandrel axially toward the base and thereby axially compressing said mandrel to cause radial expansion of said mandrel under sufficient force to radially expand said tube surrounding said mandrel; and bending another portion of said tube about the axis of said tube.

2. The method of claim 1, wherein pulling said free end of said mandrel comprises:

placing a first compression member at said free end of said mandrel and placing a second compression member at an axially fixed location at said base end of said mandrel; and drawing said first compression member axially toward said second compression member to compress said mandrel axially between said first and second compression members.

3. The method of claim 2, wherein drawing said first compression member comprises:

connecting at least one flexible tendon to said first compression member;

extending said tendon axially at least partially through said mandrel; and controllably pulling said tendon to selectively adjust the compression of the mandrel, thereby selectively expanding said mandrel.

4. The method of claim 1, further comprising:

clamping at least one die around said portion of said tube; and expanding said portion of said tube radially outwardly against said die to assume the contour of a die surface within said die.

5. The method of claim 1, wherein bending another portion of said tube comprises moving said die while said die is clamped around the expanded portion of said tube.

6. The method of claim 5, wherein moving said die positions at least a portion of said mandrel within said other portion of said tube.

7. The method of claim 6, wherein moving said die comprises rotating said die simultaneously about an axis to wrap said other portion against a bending surface.

8. A method for forming a tube, said tube having a portion to be expanded and a portion to be bent, the method comprising:

placing a resilient mandrel within said portion to be expanded;

radially expanding said mandrel to apply a deforming force to said portion to be expanded;

radially contracting said mandrel;

disposing said mandrel at least partially within said portion to be bent; and bending said portion to be bent while said mandrel is at least partially within said portion to be bent.

9. The method of claim 8, wherein said mandrel has a free end and a stationary base end, and wherein radially expanding said mandrel comprises axially compressing said mandrel by pulling said free end toward said base end.

10. The method of claim 9, wherein axially compressing said mandrel by pulling said free end comprises:

placing a first compression member at said free end of the mandrel and placing a second compression member at said base end of the mandrel at an axially fixed location; and drawing said first compression member axially toward said second compression member to compress said mandrel axially between said two compression points.

11. The method of claim 10, wherein drawing said compression member comprises:

connecting at least one bendable tendon to said first compression member;

extending said tendon axially at least partially through said mandrel; and controllably pulling said tendon to selectively adjust the compression of said mandrel thereby selectively expanding the mandrel.

12. The method of claim 11, wherein radially contracting said mandrel comprises controllably moving said tendon axially to permit said mandrel elastically to contract radially.

13. The method of claim 8, further comprising:

clamping at least two dies around said portion to be expanded before radially expanding said mandrel; and pressing said portion of said tube to be expanded radially outward against said dies with said mandrel.

14. The method of claim 13, wherein disposing said mandrel at least partially within said portion to be bent comprises:

fixing the axial position of said flexible mandrel; and moving said dies while said dies are clamped around the expanded portion of said tube, thereby moving said tube in relation to said mandrel.

15. The method of claim 14, wherein bending said portion to be bent comprises rotating said dies simultaneously about an axis to wrap another portion against a bending surface.

16. An apparatus for bulge-forming a portion of a tube, said tube having a longitudinal axis, said apparatus comprising:

a resilient, radially expandable mandrel disposable within said portion of said tube, said mandrel comprising first and second compression members at opposite ends; and means, disposed at least in part between said compression members, for axially compressing said compression members to cause radial expansion of said mandrel including at least one bendable tendon means connected to said first compression member and extending axially at least partially through said mandrel for drawing said first compression member axially toward said second compression member to compress said mandrel axially between two said compression members.

17. The apparatus of claim 16, further comprising means for controlling the axial movement of said tendon means to selectively adjust the compression of said mandrel to apply a force sufficient to selectively expand said mandrel.

18. The apparatus of claim 16, further comprising at least two dies clamped around said portion of said tube, wherein said expansion of said mandrel presses said portion of said tube radially outwardly against said dies under sufficient force to assume the contour of die surfaces on said dies.

19. The apparatus of claim 18, further comprising means for bending another portion of said tube about said axis of the tube.

20. The apparatus of claim 19, wherein said means for bending another portion of said tube comprises means for moving said dies while said dies are clamped around the expanded portion of said tube.

21. The apparatus of claim 20, wherein said means for moving said dies comprises means for positioning at least a portion of said mandrel within another portion of said tube.

22. The apparatus of claim 21, wherein said means for moving said dies comprises a rotatable swing arm for swivelling said dies simultaneously about a common bend axis.

23. The apparatus of claim 22 further comprising a bending surface, wherein said rotatable swing arm wraps another portion against said bending surface.

24. Apparatus for forming a tube said tube having a portion to be expanded and a portion to be bent, said apparatus comprising:

an elastically flexible and expandable mandrel disposable within said portion to be expanded;

means for radially expanding said mandrel to apply a deforming force to said portion to be expanded;

means for disposing said mandrel at least partially within said portion to be bent; and means for bending said portion to be bent while said mandrel is at least partially within said portion to be bent.

25. The apparatus of claim 24, wherein said mandrel comprises a free end and a stationary base end, and wherein said means for radially expanding said mandrel comprises means for axially compressing said mandrel by pulling said free end toward said base end.

26. The method of claim 25, wherein said means for axially compressing comprises:

a first compression member at said free end of said mandrel;

a second compression member at an axially fixed location at said base end of said mandrel; and means for drawing said first compression member axially toward said second compression member to compress said mandrel axially between said compression members.

27. The apparatus of claim 26, wherein said means for drawing said first compression member comprises:

at least one bendable tendon connected to said first compression member and extended axially at least partially through said mandrel; and means for controlling pulling said tendon to selectively adjust the compression of said mandrel thereby selectively expanding said mandrel.

28. The apparatus of claim 24, further comprising at least two dies clamped around said portion to be expanded, and wherein said portion of said tube to be expanded is pressed radially outward against said dies by said mandrel.

29. The method of claim 28, wherein said means for disposing said mandrel at least partially within said portion to be bent comprises:

means for fixing the axial position of said mandrel; and means for moving said dies while said dies are clamped around the expanded portion of said tube thereby to move said tube in relation to said mandrel.

30. The apparatus of claim 29, wherein said means for bending the portion to be bent comprises means for rotating said dies simultaneously about an axis to wrap said portion to be bent against a bending surface.

31. The apparatus of claim 30, wherein said means for controllably pulling said tendon comprises a hydraulic cylinder, and wherein said means for fixing said axial position of the mandrel comprises a rigid mandrel rod.

32. The apparatus of claim 30, wherein said means for moving said dies and said means for rotating said dies comprises a swivable swing arm.

* * * * *